US009596912B2

(12) United States Patent
Sacks

(10) Patent No.: US 9,596,912 B2
(45) Date of Patent: Mar. 21, 2017

(54) T-HANDLE FOLDING CANE WITH UNOBTRUSIVE TABLE CLAMP

(71) Applicant: Jerome E Sacks, Lexington, MA (US)

(72) Inventor: Jerome E Sacks, Lexington, MA (US)

( * ) Notice: Subject to any disclaimer, the term of this patent is extended or adjusted under 35 U.S.C. 154(b) by 0 days.

(21) Appl. No.: 14/860,062

(22) Filed: Sep. 21, 2015

(65) Prior Publication Data

US 2016/0262506 A1 Sep. 15, 2016

Related U.S. Application Data

(60) Provisional application No. 62/113,471, filed on Feb. 8, 2015, provisional application No. 62/197,049, filed on Jul. 26, 2015.

(51) Int. Cl.

| | |
|---|---|
| ***A45B 1/04*** | (2006.01) |
| *A45B 9/02* | (2006.01) |
| *A45B 9/00* | (2006.01) |
| *A45B 7/00* | (2006.01) |

(52) U.S. Cl.

CPC ..... *A45B 1/04* (2013.01); *A45B 7/005* (2013.01); *A45B 9/02* (2013.01); *A45B 2009/005* (2013.01); *A45B 2009/007* (2013.01)

(58) Field of Classification Search

CPC ..... A45B 1/00; A45B 1/04; A61H 2003/0255
USPC ..... 135/66; 248/689, 229.12
See application file for complete search history.

(56) References Cited

U.S. PATENT DOCUMENTS

| | | | | | |
|---|---|---|---|---|---|
| 4,300,742 | A * | 11/1981 | Hunn | A45B 1/04 | 248/229.26 |
| 4,895,330 | A * | 1/1990 | Anstead | A47G 25/12 | 248/229.12 |
| 5,000,418 | A * | 3/1991 | Vogt | A45B 1/04 | 248/205.1 |
| 5,573,025 | A * | 11/1996 | Atlas | A45B 1/04 | 135/65 |
| 6,488,042 | B2 * | 12/2002 | Troyer | A45B 1/00 | 135/65 |
| 9,307,855 | B2 * | 4/2016 | Widess | A47G 25/12 | |
| 2008/0149155 | A1 * | 6/2008 | Martin | A45B 3/00 | 135/66 |
| 2014/0083475 | A1 | 3/2014 | Murphy | | |

(Continued)

FOREIGN PATENT DOCUMENTS

| | | | | |
|---|---|---|---|---|
| CA | 2816206 | A1 * | 11/2014 | A45B 1/04 |
| FR | WO 9512342 | A1 * | 5/1995 | A47G 25/12 |
| NL | WO 2010036112 | A2 * | 4/2010 | A45B 1/04 |

*Primary Examiner* — Noah Chandler Hawk
(74) *Attorney, Agent, or Firm* — Jerome E Sacks

(57) ABSTRACT

The inventive concept presented herein is a t-handle folding cane that when extended for walking appears to be a standard t-handle cane. However when the cane is folded, it is designed to be hung from various horizontal surfaces such as a table top, a dresser with a lip, or a bookcase, etc. Embodiments include a) a clamp that has a slider jaw that allows the handle-bottom and slider jaw to be clamped to a table top, b) a slider jaw extension that extends the length of the slider jaw, c) a constant force spring, d) a handle modification that allows the handle to be extended so the cane is better balanced when hung from a table, and e) modifications to the shaft so a user's grip on the handle lies directly over the cane's point of contact to the ground.

8 Claims, 10 Drawing Sheets

(56) References Cited

U.S. PATENT DOCUMENTS

| | | | | |
|---|---|---|---|---|
| 2014/0261593 | A1* | 9/2014 | Howarth | A45B 9/00<br>135/74 |
| 2014/0299168 | A1* | 10/2014 | Crowhurst | A45B 9/04<br>135/67 |

* cited by examiner

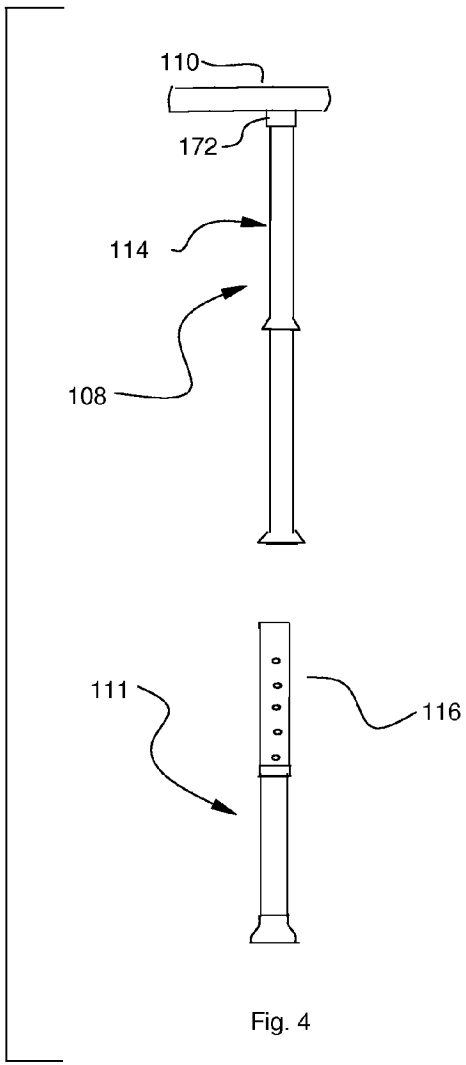
Fig. 4
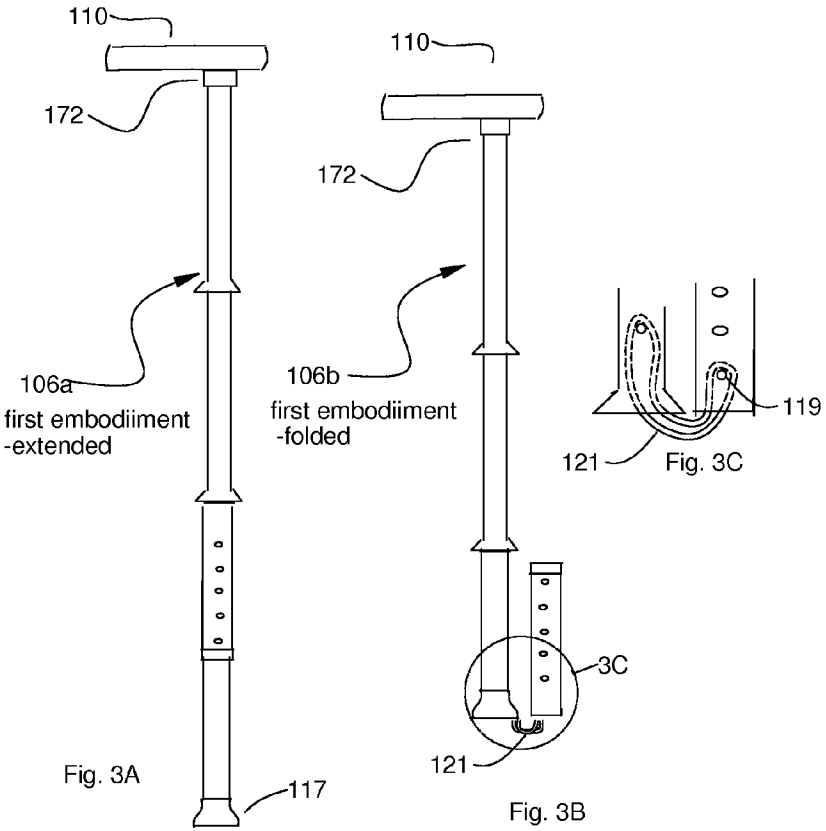
Fig. 3A
Fig. 3B
Fig. 3C

T-HANDLE FOLDING CANE WITH UNOBTRUSIVE TABLE CLAMP

STATEMENT REGARDING FEDERALLY SPONSORED RESEARCH OR DEVELOPMENT

Not Applicable

REFERENCE TO SEQUENCE LISTING, TABLE, OR A COMPUTER PROGRAM LISTING

Not Applicable

COMPACT DISK APPENDIX

Not Applicable

BACKGROUND OF THE DISCLOSURE

There exists many canes that aid a person to walk. However, when that person goes into a restaurant, storing the cane may pose a problem. If there is a coat hook nearby, the cane may be hung on the hook. If the cane is a folding cane, the cane may be folded in two or four parts, making it easy to put the cane on a seat without taking up too much room. However there is no easy way to hang the cane from various types of tables; for example a table with a hard surface, a table with a tablecloth, a table with an uneven surface but with a ledge, etc., and other horizontal surfaces.

For the purpose of this paper we consider two popular types of folding canes. A t-handle cane is illustrated in FIGS. 1A and 1B, and the offset cane is illustrated in FIGS. 2A and 2B. The t-handle cane is more attractive and is often considered fashionable, while the offset cane provides more stability at the cost of calling attention to a potential disability. Note that in many cases the folded offset cane may hang from a table when folded, however it would be nice if the t-handle cane could accomplish this also. The purpose of this invention is to provide an attractive folding cane that hangs securely and neatly from a table or other horizontal surface, yet is unobtrusive when configured as a walking stick for walking.

SUMMARY OF THE DISCLOSURE

The cane is designed so that when the cane is configured for walking, the cane appears like a standard t-handle cane with a decorative ring. However when folded and configured for attaching to a horizontal surface, the decorative ring is actually a slider that functions, together with the handle, as a clamp. The first embodiment of the inventive concept presented herein is a cane top assembly that attaches through an elastic hinge to a folding shaft bottom assembly. The cane top assembly is composed of two parts, a handle and a handle shaft. The first embodiment adds two novel features: a) a clamp integrated with the cane top assembly that allows the handle to be clamped to a table top, and b) a handle extension that allows the handle to be extended so the cane is better balanced when hung from a horizontal surface such as a table top.

In the first embodiment of the current invention, a constant force spring is used. The cane is designed so when it is configured for walking the clamp parts are unobtrusive. Other embodiments are presented, which include changing the angle between the handle and the shaft so downward force of the user's hand lies directly above the cane bottom tip.

BRIEF DESCRIPTION OF THE DRAWINGS

FIGS. 3A and 3B illustrate a first embodiment of the current invention.

FIG. 3C is a detail of FIG. 3B.

FIG. 4 illustrates the folding cane comprised of two assemblies.

DETAILED DESCRIPTION

Directional terms such as "top", "bottom", "left", "right" and the like are used in the description. These terms are applicable to the embodiments illustrated and described in conjunction with the drawings. These terms are merely used for the purpose of description in connection with the drawings and do not necessarily apply to the position in which the embodiment may be used. The term extendable slider jaw refers to a jaw that may be configured to have more than one jaw length. However a slider jaw with only one jaw length is included in this definition, although it has limited application.

Figure 1B:
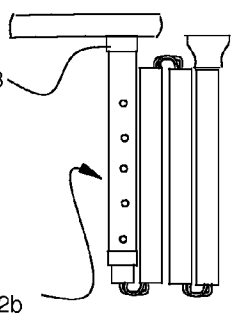
Fig. 1B (Prior Art)
FIGS. 1A and 1B illustrate prior art t-handle canes in an extended and folded configuration respectively.
Figure 1A:
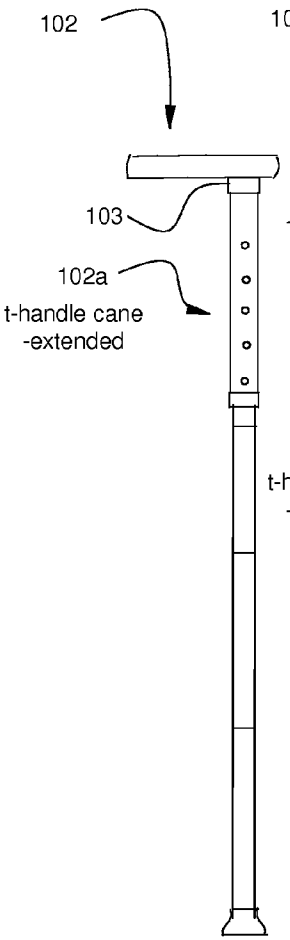
Fig. 1A (Prior Art)

The first embodiment of the inventive concept presented herein is an improved cane handle that works with the folding parts of a typical folding cane; herein called a folding t-handle cane 102. FIG. 1A illustrates a prior art extended t-handle cane 102*a*, extended for walking. FIG. 1B illustrates a prior art folded t-handle cane 102*b*, folded for storage. Note that the folding t-handle cane 102 has a decorative ring 103.

Figure 2B:
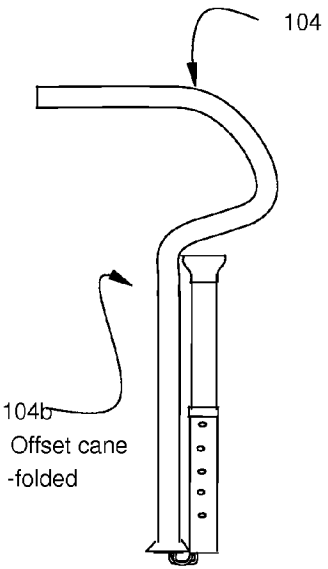
Fig. 2B (Prior Art)
FIGS. 2A and 2B illustrate prior art offset canes in an extended and folded configuration respectively.
Figure 2A:
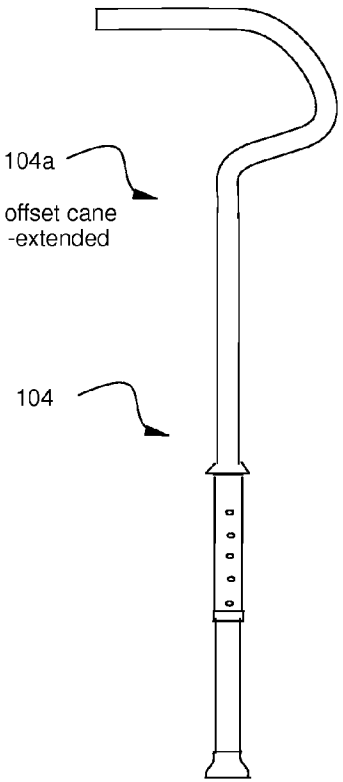
Fig. 2A (Prior Art)

FIG. 2A illustrates a prior art second type of folding cane, called an offset folding cane 104. FIG. 2A illustrates the offset folding cane—extended 104*a* extended for walking. FIG. 2B illustrates the offset folding cane—folded 104*b* folded for storage.

FIGS. 3A and 3B illustrate a first embodiment 106 of the current invention. FIG. 3A illustrates the first embodiment 106 of the t-handle cane presented herein. FIG. 3A illustrates the first embodiment 106*a* in an extended configuration, and FIG. 3B illustrates the first embodiment 106*b* in a folded configuration. First embodiment 106 has a slider 172 which appears similar to the decorative ring 103. The slider is comprised of a cylinder 127 and an extendable slider jaw 171.

FIG. 3C is a detail of FIG. 3B in an expanded scale where the cane top assembly 108 and the cane bottom assembly 111 are hinged for folding. The elastic hinge 121 connects these two assemblies using two rivets 119 in the usual manner for constructing elastic hinges in a folding cane.

FIG. 4 illustrates the folding cane comprised of two assemblies. Referring to FIG. 4, the t-handle folding cane is comprised into two assemblies, the cane top assembly 108 and the cane bottom assembly 111. The cane top assembly 108 is further composed of two components, the grip component 110 and the shaft component 114. Attention in the detailed specification is focused primarily on the cane top assembly 108. The cane bottom assembly construction and the means of foldably attaching the cane bottom assembly to the cane top assembly are well known in the art of folding cane construction. Observe however that the height adjusting mechanism 116 occurs in the cane bottom assembly 111 as opposed to the prior art t-handle canes, where the height adjusting mechanism 116 occurs in the cane top assembly 108.

Figure 5:
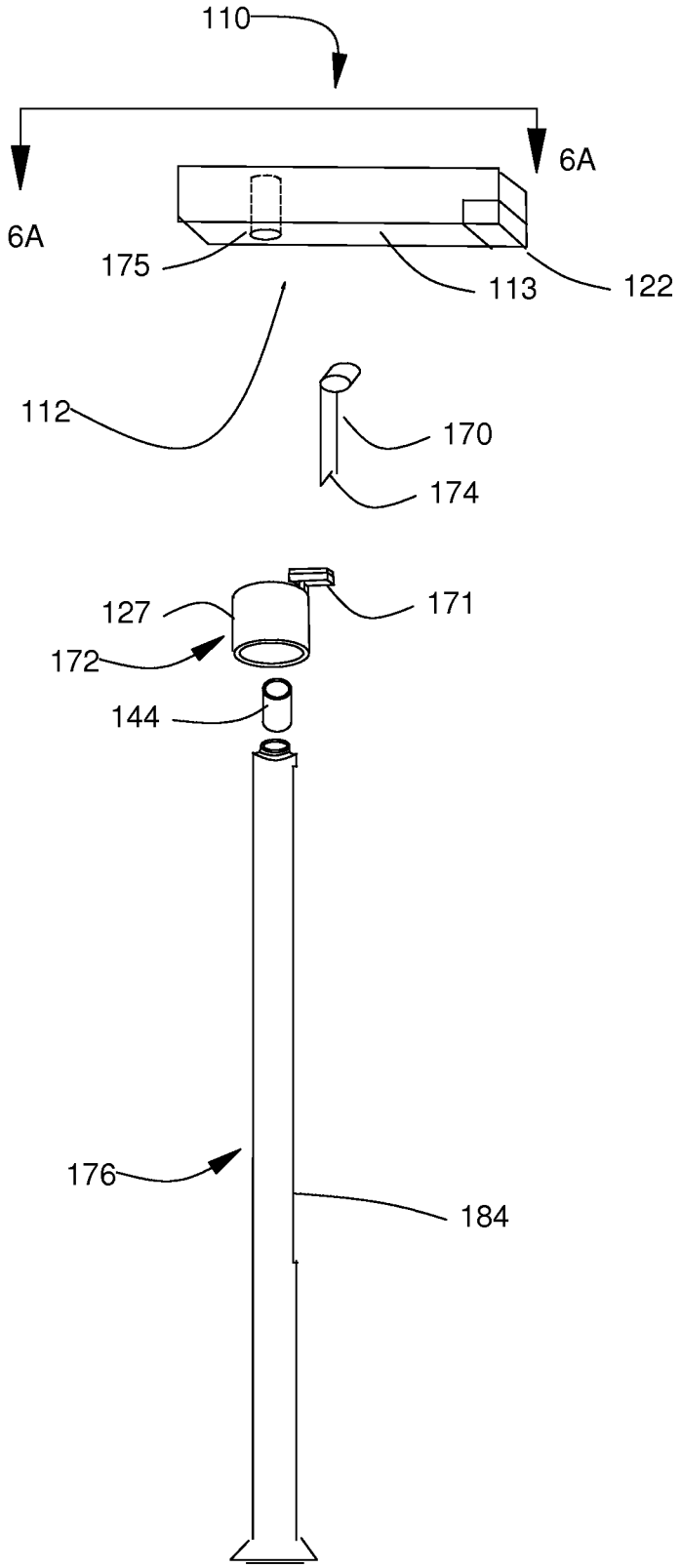
FIG. 5 illustrates an exploded front perspective view of the first embodiment.
Figure 6B:
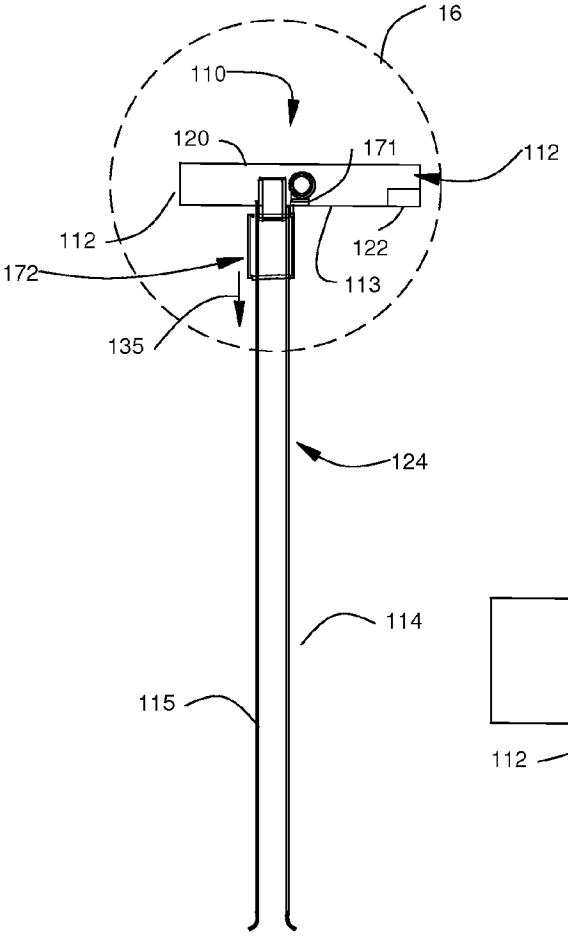
FIG. 6B illustrates the same section when the slider is up.
Figure 6A:
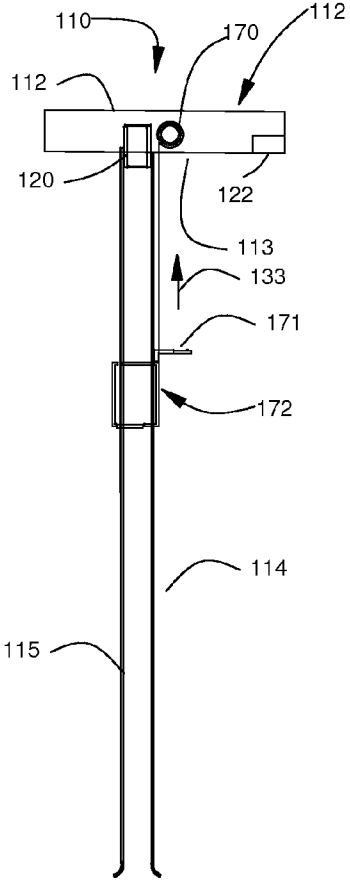
FIG. 6A illustrates a sectional view of the first embodiment when the slider is down; the section indicated in FIG. 5.

FIGS. 5, 6A and 6B illustrate the first embodiment of the current invention. In this embodiment, a constant force spring 170 is used to control the slider motion, and an extendable slider jaw 171 is used to extend the jaw.

Figure 7:
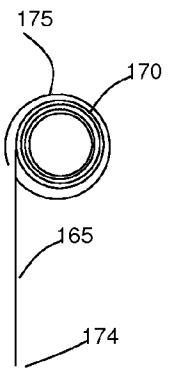
FIG. 7 is a sectional view of the constant force spring and handle cavity embedded in the handle.
Figure 8:
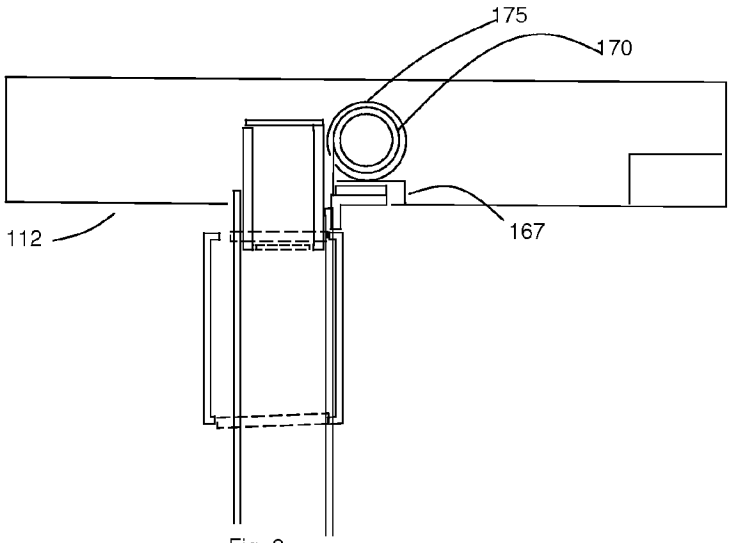
FIG. 8 is a view of a portion of FIG. 6B in an expanded scale.

FIG. 5 illustrates an exploded front perspective view of this embodiment. FIG. 6A illustrates a sectional view of this embodiment when the slider 172 is down; the section illustrated in FIG. 5. FIG. 6B illustrates the same section when the slider 172 is up. FIG. 7 is a sectional view of the constant force spring 170 with constant force spring end 174 and handle circular cavity 175 where the constant force spring 170 is embedded in handle 112. FIG. 8 is a sectional view of a portion of FIG. 6B in an expanded scale.

Figure 9A:
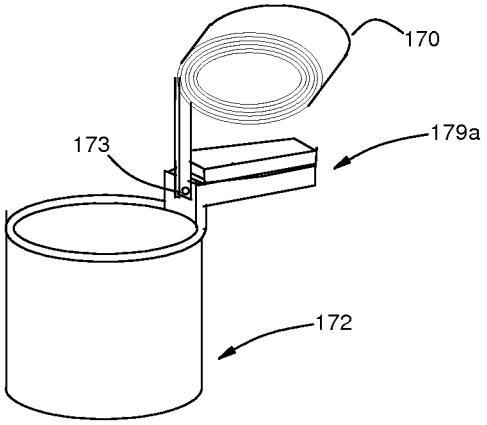
FIGS. 9A and 9B illustrate front perspective views of the extendable jaw in an alternate embodiment.
Figure 10A:
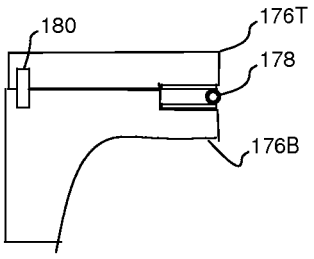
FIGS. 10A and 10B illustrate the extendable slider jaw when it is closed and extended respectively.
Figure 15:
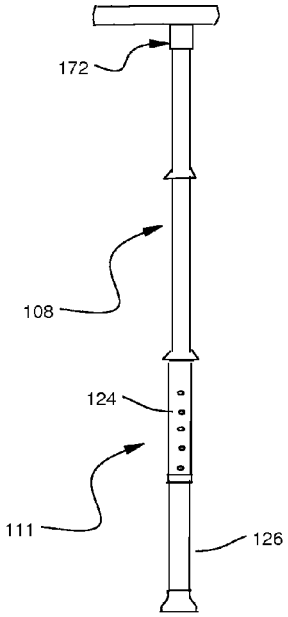
FIGS. 15 through 16C illustrate the first embodiment in a walking configuration and in various hanging configurations.

Referring to FIGS. 6A and 6B, the constant force spring 170 is used to apply an internal force 133 applied in an upward direction on the slider 172 toward the handle when the slider is in a down position (FIG. 6A). When the slider is in the up position (FIG. 6B), a user can apply an external force 135 to push the slider away from the handle 112 so the extendable jaw part can be used to clamp on a horizontal surface. Constant force springs are typically constructed as a rolled ribbon of spring steel and provide an approximately constant force as the spring is extended to various lengths. The slider 172 fits around the handle shaft component 176. As indicated in FIGS. 6A and 6B, the constant force spring 170 is embedded in the handle 112 with the constant force spring end 174 attached to the slider 172. When the slider 172 is in the up position, the slider 172 and extendable slider jaw 171 are hidden in the handle 112 as illustrated in FIG. 6B and is unobtrusive. When the slider 172 are in the down position, the extendable slider jaw 171 is used with the bottom of the handle 112 as a clamp that attaches to a table horizontal surface (FIGS. 6A,16B and 16C). The extendable slider jaw 171, when used as a clamp, may either be extended or closed, depending on the table structure, as illustrated in FIGS. 15 through 16C. When the extendable slider jaw 171 is in a jaw closed mode as indicated in FIGS. 9A and 10A, the cane may be configured for walking with the extendable slider jaw 171, when closed, is partially hidden by being partially embedded in a handle recess 167 located in the handle 112 as illustrated in FIG. 8. Alternately, it may in a jaw extended mode being used as a clamp as indicated in FIGS. 16B and 16C. Depending on the horizontal surface being clamped to, the jaw may be either extended (FIG. 16C) or closed (FIG. 16B) as appropriate.

Referring to FIG. 5 the grip component 110 is comprised of the handle 112 with a handle circular cavity 175, and a handle extension component 122. In addition, the cane top assembly 108 is comprised of two shaft parts, the handle shaft component 176 and the handle shaft tube 115.

Also illustrated in FIG. 5 is a slider 172. The slider 172 is comprised of a cylinder 127 with an extendable slider jaw 171 protruding outwards from the top of the cylinder 127. The cylinder 127 is adapted so it slides smoothly and snugly over the shaft component 114

Figure 9B:
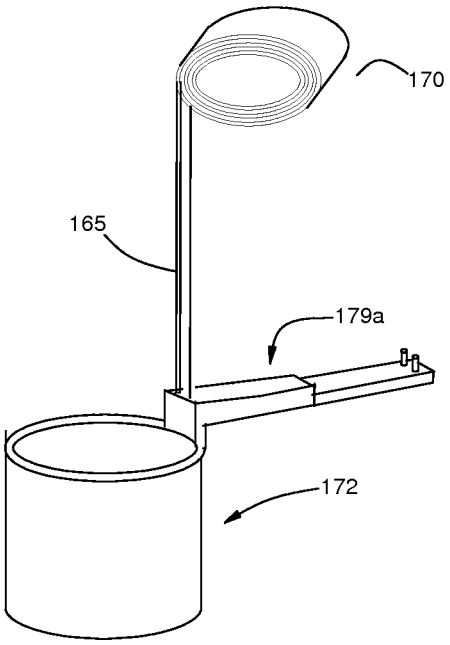
Figure 10B:
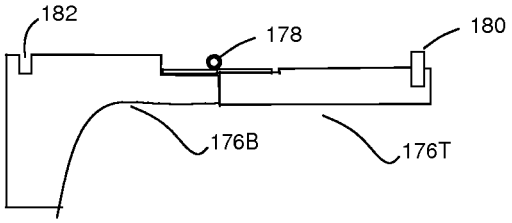

FIGS. 9A and 9B illustrate front perspective views of a first extendable slider jaw 171*a*, an implementation of extendable slider jaw 171. Also illustrated in these two figures are the constant force spring 170 attached to the slider 172 when in an up position and down position respectively. FIGS. 10A and 10B are sectional views of the extendable slider jaw 171 when it is closed and extended respectively. Referring to FIGS. 9A, 9B, 10A and 10B, the first extendable slider jaw 171*a* has a jaw bottom part 176B and a jaw top part 176T attached by a hinge 178. Also included are two pegs 180 attached to the jaw bottom part 176B as illustrated in FIGS. 9B, 10A and 10B. The two pegs 180 are matched to two holes 182 located on the jaw bottom part 176B. When the extendable slider jaw 171 is closed as indicated in FIGS. 9A and 10A, the two pegs 180 fit in the two holes 182. In this case the extendable slider jaw 171 has a jaw closed length 163. When the first extendable slider jaw 171*a* is opened, the top surface of the lower jaw lies in the same plane as the top of the two pegs 180, thereby able to apply an upper force on a tabletop bottom, for almost the full length of the extendable slider jaw 171. In this case the first extendable slider jaw 171*a* has a jaw extended length 164. FIG. 9A also shows a rivet 173 attaching to constant force spring 170 to first extendable slider jaw 171*a*.

Figure 10C:
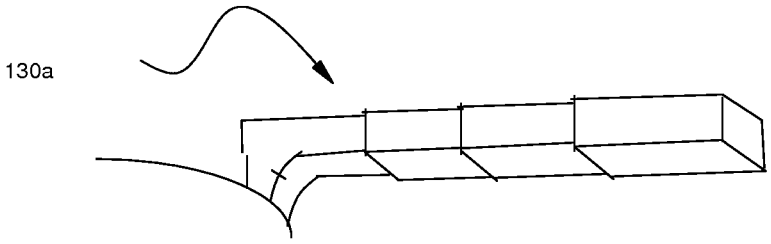
FIG. 10C illustrate an alternate extendable slider jaw.

FIG. 10C illustrates another alternate embodiment for extendable slider jaw 171, where the extendable slider jaw 171 is to be extended. Second extendable slider jaw 171*b* is constructed similar to a portable radio extendable antenna.

Figure 11:
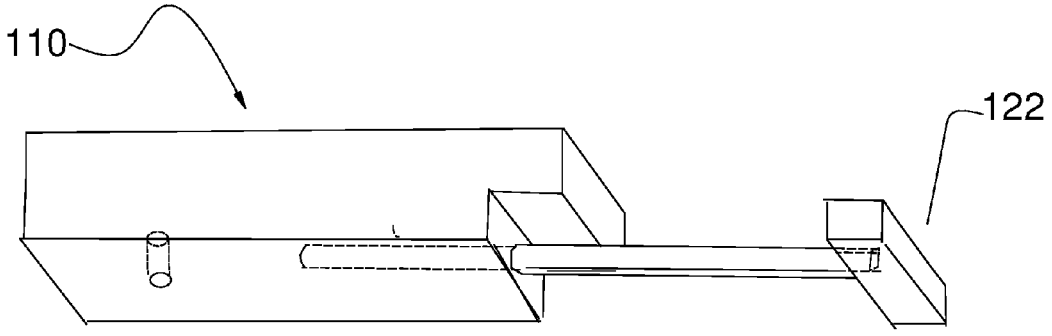
FIG. 11 illustrates the handle with a handle extension component.

FIG. 11 illustrates the handle 112 which allows the handle extension component 122 to be closed when the cane is used in the walking configuration, but may be extended when secured on a table. Although not illustrated in the figure, the handle extension component 122 has mechanisms that hold the handle extension component securely in place when closed and when opened.

Figure 12:
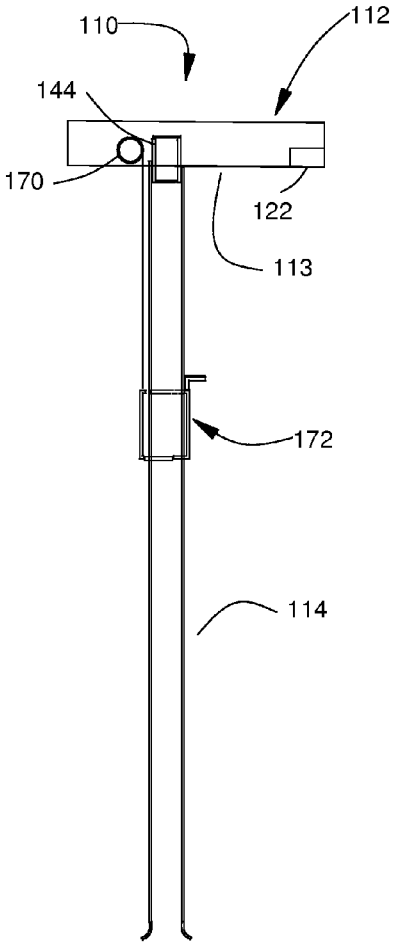
FIG. 12 illustrates an alternate embodiment where the constant force spring is positioned on the opposite side of the handle of the extendable jaw.
Figure 13:
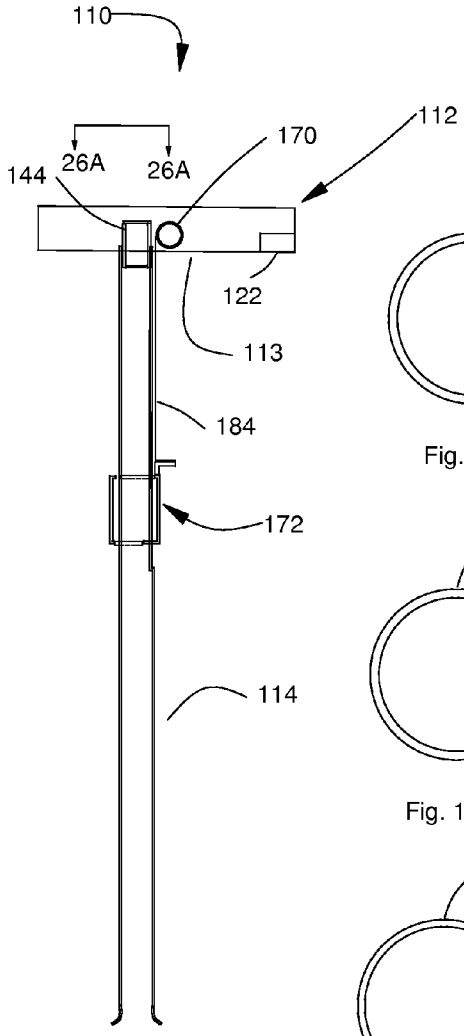
FIG. 13 illustrates a modification to the shaft component that accommodates the constant force spring.
Figure 14A:
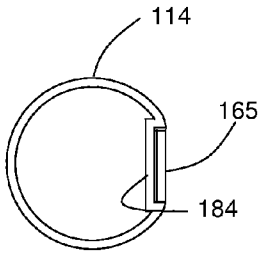
FIGS. 14A through 14C presents three of sectional view designs of a detail of FIG. 13.
Figure 14B:
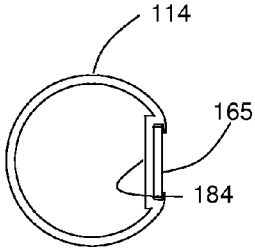
Figure 14C:
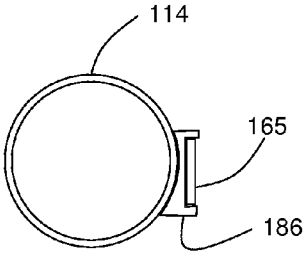

Other embodiments are also consistent with the current invention. Referring to FIG. 12, the constant force spring 170 is positioned on the opposite side of the handle where the extendable slider jaw 171 is. FIG. 13 illustrates a modification to the shaft component 114 that has a shaft recess 184 that accommodates the constant force spring 170. FIGS. 14A and 14B present sectional views illustrating two alternate designs of the blade extended portion 165 of the constant force spring 170 fitting in shaft recess 184 of the shaft component 114. Also shown is another modification to the embodiment where a protrusion 186 (see FIG. 14C) is attached to the handle shaft tube 115 and hides the blade extended portion 165 of the constant force spring 170. Note that the shaft recesses 184 and the protrusions 186 serve to hide the constant force spring 170 when it is extended. The shaft recess 184 and the slider with the extendable slider jaw 171 when used together make the cane, when used for walking, look almost like a standard t-handle cane, i.e. is unobtrusive.

Figure 16A:
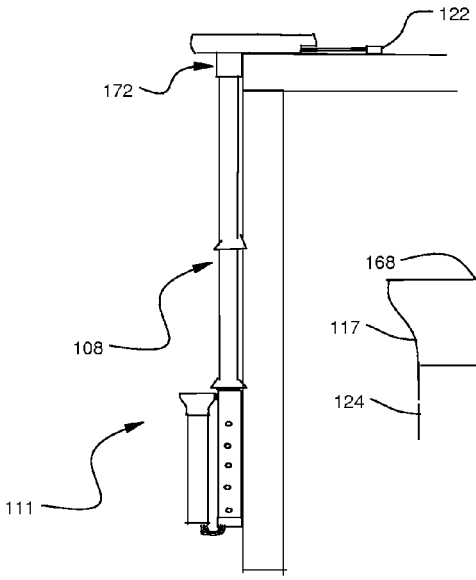
FIG. 16D illustrates a detail of FIG. 16C in an expanded scale.
Figure 16D:
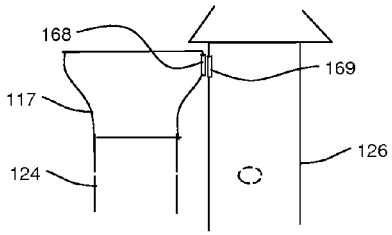
Figure 16B:
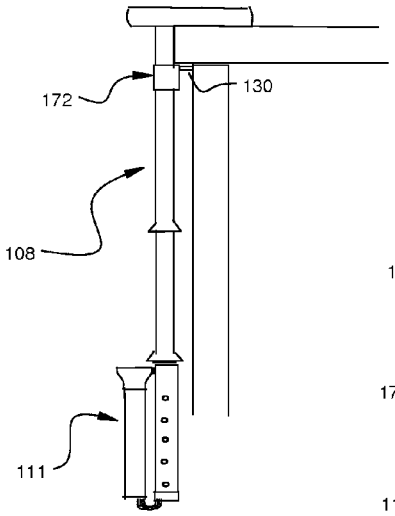
Figure 16C:
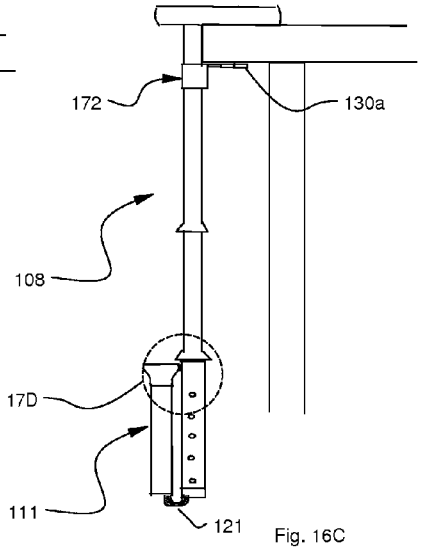

FIGS. 15 and 16A through 16C illustrate the cane in an extended position for walking and in folded positions attached to three different horizontal surfaces. Note that the cane bottom assembly 111 is comprised of a first shaft part having a shaft bottom tip 117 at the end that touches the ground, and has a magnetic disk 168 imbedded in the shaft bottom tip 117. The cane bottom assembly 111 is comprised of a first bottom shaft part 124 having a magnetic disk 168 and a second bottom shaft part 126 having a magnet 169 imbedded in the second bottom shaft part 126 so the folded bottom assembly when folded holds together, as illustrated in FIG. 16D, which is a detail of FIG. 16C. When the cane is assembled and the cane bottom assembly is folded as illustrated in FIGS. 16A through 16C, the cane may be clamped to the horizontal surface of a table without touching the ground.

Figure 17:
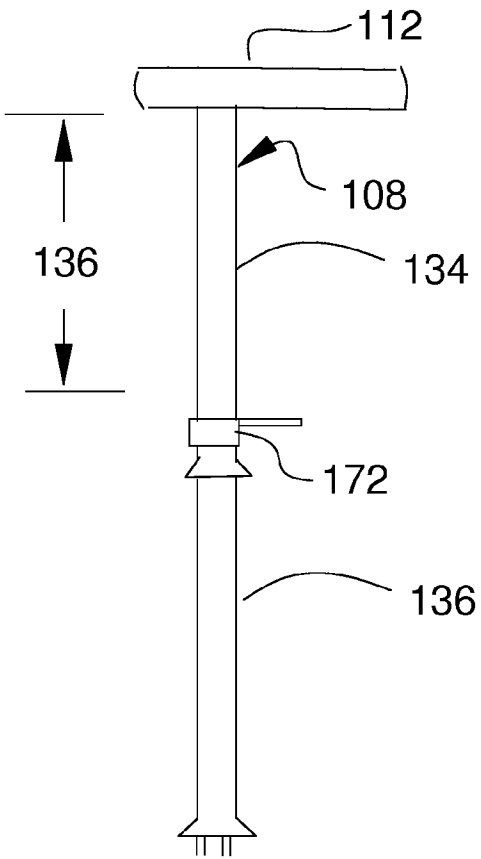
FIG. 17 illustrates the cane top assembly with the first shaft part 124 and second shaft part 126 attached in the standard way for folding canes with the slider in the down position.

FIG. 17 illustrates the cane top assembly 108 with the first top shaft part 134 and second top shaft part 136 attached in the standard way for folding canes. The slider 172 is in the down position. For this configuration, the first path length 128 for the slider movement is about 6 inches.

Figure 18A:
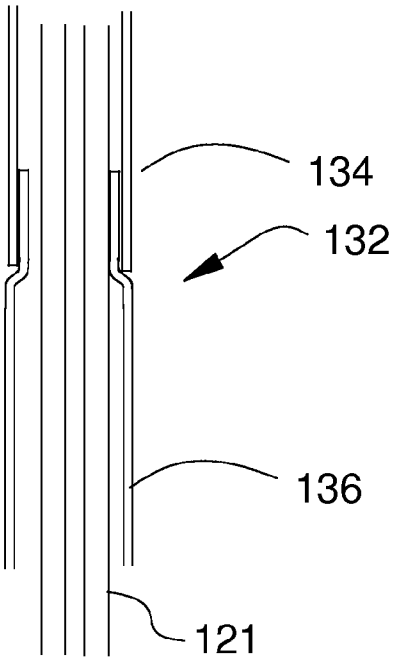
FIG. 18A illustrates a sectional view of the folding joint 132 on an enlarged view.
Figure 18:
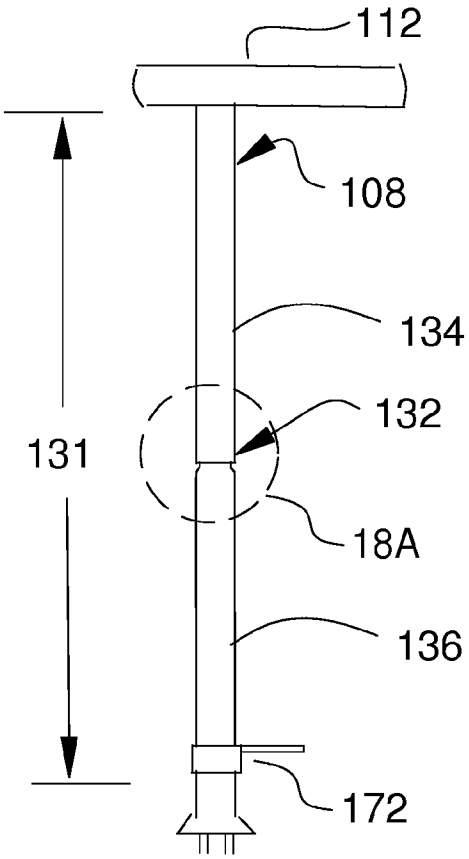
FIG. 18 illustrates an alternate embodiment where modifying the folding joint in the cane top assembly is modified.

FIG. 18 illustrates an alternate embodiment where the second path length 131 is about 12 inches. This is accomplished by modifying the folding joint 132 as shown in FIG. 18A. Referring to FIG. 18A, the second top shaft part 136 has its top inserted in the bottom of the first top shaft part 134 so the slider can slide smoothly over the folding joint 132. The elastic hinge 121 functions as usual.

Figure 19A:
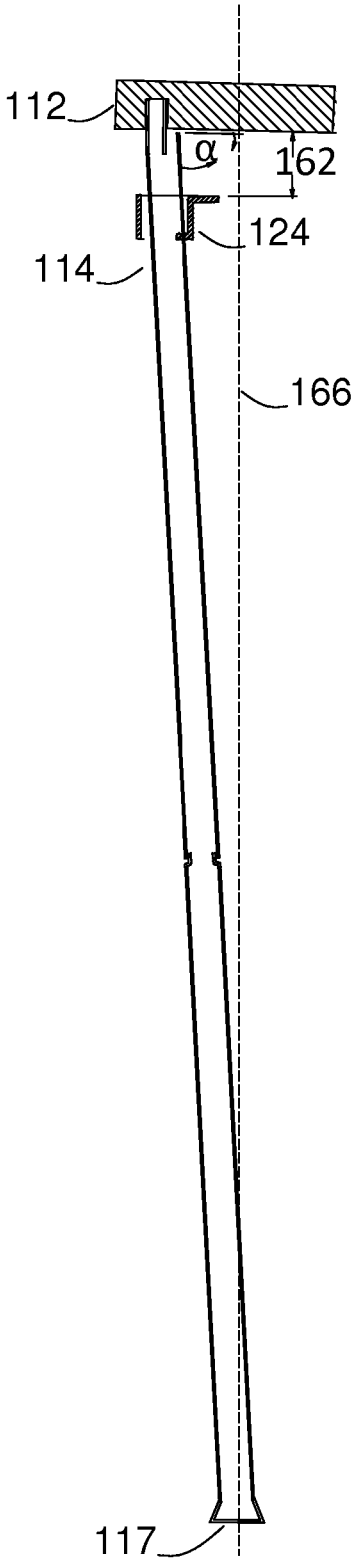
FIGS. 19A and 19B illustrate another alternate embodiment.
Figure 19B:
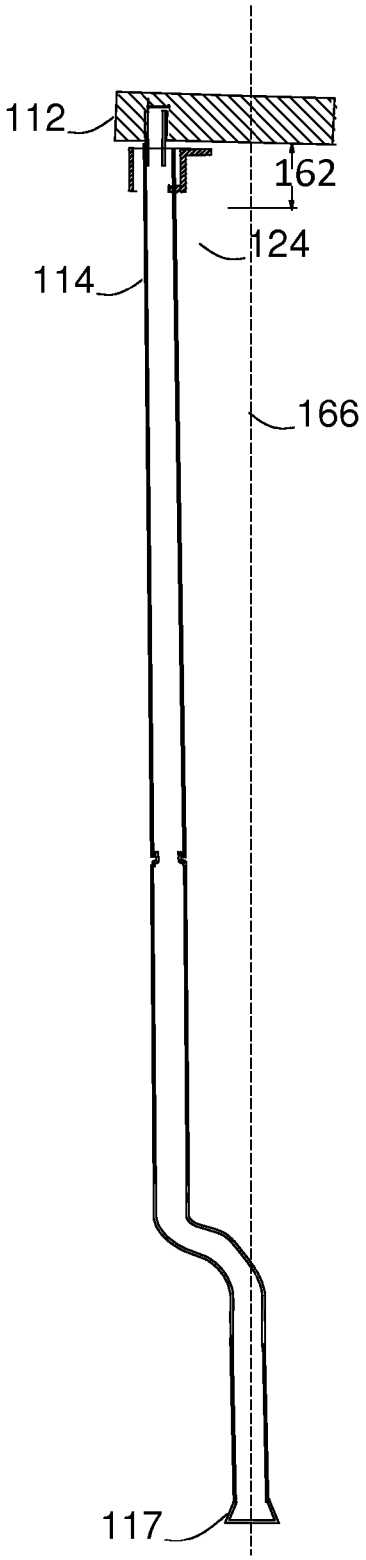

FIGS. 19A and 19B illustrate two alternate embodiments. In these embodiments, the cane handle and shaft may be configured so that the user's grip on the hand lies directly above the point where the shaft bottom tip 117 touches the ground. Referring to FIG. 19A, in this alternate embodiment, the angle $\alpha$ between the handle bottom 113 of the handle 112 and the shaft component 114 is set at a small acute angle. The angle $\alpha$ is determined so when the cane is configured for walking, the shaft bottom tip 117 of the handle 112 lies under the handle 112 so that the downward force on the handle 112 is directed in a pure vertical direction as indicated by the vertical line 166. This approximates the downward force distribution similar to that provided by the offset folding cane 104. This also provides better weight distribution when the cane is hung from a table, since it provides a torque forcing the end of the handle 112 downward on the table top. In another alternate embodiment illustrated in FIG. 19B, the cane bottom assembly 111 is shaped so that when a user grips the handle, the downward force will be directly over the shaft bottom tip 117.

When the cane is configured for walking with the extendable slider jaw 171 contracted and partially hidden in the handle 112 the clamping parts are unobtrusive. The cane therefore appears as an ordinary walking stick.

The disclosure presented herein gives multiple embodiments of the present invention. These embodiments are to be considered as only illustrative of the invention and not a limitation of the scope of the present invention. Various permutations, combinations, variations, and extensions of these embodiments are considered to fall within the scope of this invention.

What is claimed is:

1. A cane device comprised of a cane top assembly, said cane top assembly comprised of:

a handle;

a shaft component; said shaft component attached to said handle; said shaft component comprised of a handle shaft tube;

said handle being oriented perpendicularly to said shaft, said handle being located at the topmost end of said shaft;

a slider slidingly attached to said handle shaft tube;

said slider additionally comprised of a cylinder and an extendable slider jaw, said extendable slider jaw protruding away from said cylinder;

a constant force spring installed outside of said handle shaft tube;

said cane device adapted so that said slider being capable of sliding away from said handle using said constant force spring when an external force is applied to said slider away from said handle;

said cane device further adapted so that when said slider is positioned away from said handle and said external forces is released, then said cane device applies an internal force using said constant force spring to said slider wherein said internal force attempts to move said slider towards bottom of said handle;

and wherein said extendable slider jaw has a jaw closed mode and at least one jaw extended mode wherein each of said at least one jaw extended mode has length greater than said jaw closed mode;

and wherein said extendable slider jaw in said jaw closed mode and each of said one jaw extended mode being capable of functioning as a clamp when said extendable slider jaw operationally interacts with bottom of said handle.

2. The cane device of claim 1 wherein said extendable slider jaw configured so that when top of said extendable slider jaw is configured in said jaw closed mode and is positioned against said bottom of said handle, said extendable slider jaw fits in a handle recess of said handle.

3. The cane device of claim 1 wherein said extendable slider jaw has two jaw modes, a jaw extended mode and said jaw closed mode wherein when said extendable slider jaw being in said jaw closed mode then said extendable slider jaw having a jaw closed length, and wherein said extendable slider jaw being in said jaw extended mode, then said extendable slider jaw having a jaw extended length wherein said jaw extended length being greater that said jaw closed length.

4. The cane device of claim 1 wherein a first portion of said constant force spring being mounted inside said handle, and a blade extended portion of said constant force spring is positioned outside of said handle, and wherein end of said constant force spring being attached to said slider, said constant force spring being adapted so that when said slider is pulled away from said handle by said external force, said extendable slider jaw is capable of clamping onto a horizontal surface; and when said external force is the released, then said constant force spring applies said internal force that pulls said slider towards said handle so said extendable slider jaw is capable of clamping onto said horizontal surface with said extendable slider jaw and bottom of said handle functioning as a clamp.

5. The cane device of claim 4 has a shaft recess in said handle shaft tube, said shaft recess being adapted so that when said constant force spring is extended, said blade extended portion of said constant force spring is partially hidden.

6. The cane device of claim 1 further comprising a cane bottom assembly wherein said cane bottom assembly is comprised of:

a first shaft part, said first shaft part having a shaft bottom tip a second shaft part, and an elastic hinge wherein said first said first shaft part is foldable against said second shaft part and said first shaft part is removably attachable to said second shaft part whereby when said first shaft part is attached to said second shaft part then said cane device may be attached to a horizontal surface of a table without touching floor.

7. The cane device of claim 6 wherein said first shaft part has an embedded magnetic piece in said shaft bottom tip and said second shaft part having an attached magnet, said cane bottom assembly adapted wherein said first shaft part and said second shaft part are removably attachable using said embedded magnetic piece and said attached magnet are used to removably attach said first shaft part to said second shaft part.

8. The cane device of claim 1 wherein said handle has a handle extension component which is hidden in the handle, but is capable of being extended in a direction away from said handle shaft tube along longitudinal axis of the handle so said cane device better secures to a horizontal surface.

* * * * *